US006992640B2

(12) United States Patent
Usami et al.

(10) Patent No.: US 6,992,640 B2
(45) Date of Patent: Jan. 31, 2006

(54) RADOME

(75) Inventors: Ryo Usami, Tokyo (JP); Tsuyoshi Ozaki, Tokyo (JP); Jun Tsuruta, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 86 days.

(21) Appl. No.: 10/724,739

(22) Filed: Dec. 2, 2003

(65) Prior Publication Data

US 2004/0246194 A1 Dec. 9, 2004

(30) Foreign Application Priority Data

Jun. 9, 2003 (JP) ..... 2003-164110

(51) Int. Cl.
*H01Q 1/42* (2006.01)

(52) U.S. Cl. ..... 343/872; 343/705

(58) Field of Classification Search ..... 343/705, 343/872, 873

See application file for complete search history.

(56) References Cited

U.S. PATENT DOCUMENTS 4,358,772 A * 11/1982 Leggett ..... 343/872
4,506,269 A * 3/1985 Greene ..... 343/872
5,323,170 A * 6/1994 Lang ..... 343/872
5,408,244 A * 4/1995 Mackenzie ..... 343/872
5,662,293 A * 9/1997 Hower et al. ..... 244/133
5,936,025 A 8/1999 Lee et al.
6,107,976 A * 8/2000 Purinton ..... 343/872

FOREIGN PATENT DOCUMENTS

JP 2002-299938 10/2002

OTHER PUBLICATIONS

"Antenna Engineering Handbook," *Institute of Electronics, Information and Communication Engineers*, Oct. 30, 1980, pp. 301.

* cited by examiner

*Primary Examiner*—Shih-Chao Chen
(74) *Attorney, Agent, or Firm*—Leydig, Voit & Mayer, Ltd.

(57) ABSTRACT

A radome has a structure in which core portions are laminated to opposite side surfaces of a high relative-dielectric-constant layer, respectively, and skin portions are additionally laminated to opposite side surfaces of the laminate, respectively. Furthermore, the skin portions laminated to the outside surfaces are coated with a coating material. The radome accommodates an antenna. The high relative-dielectric constant layer has a relative dielectric constant that is larger than the relative dielectric constants of the skin portions, and of the core portions.

4 Claims, 2 Drawing Sheets

RADOME

BACKGROUND OF THE INVENTION

1. Field of the Invention

The present invention relates to a radome that accommodates a radar, and more particularly the invention relates to a radome that is installed in an aircraft, a vehicle, or the like, and that has an aerodynamic shape.

2. Description of the Related Art

With recent improvements in communication technology and information processing technology, a technology for two-way communicating from an aircraft, a vehicle, or the like is being placed in practical use. Particularly for the aircraft, in order to communicate from an installed antenna system therein through the medium of satellites, a wider beam scanning range than the conventional is demanded. Therefore, it is required of the radome that the loss of an electromagnetic wave caused by the reflection of the wave input and output by the antenna be small on the wall of the radome over the wider range of the antenna scanning angle.

In a radome having an aerodynamic shape providing a small resistance to the air in contrast to a ground radome having a hemispherical shape, the angle of incidence of the electromagnetic wave on the wall of the radome is not uniform. In general, when the electromagnetic wave impinges on the wall of the radome at a large angle to the wall, the loss thereof is large. Accordingly, in order to lower the loss of the electromagnetic wave input and output through the antenna at a wider scanning angle of the antenna, it is requested that the loss of the electromagnetic wave occurred through the wall of the radome be small over the wider range of the angle of incidence. A radome used for an aircraft, for instance, is usually produced such that the radome has a sandwich structure obtained by placing a core portion (material) between skin portions (materials) and laminating these materials. For instance, "The Handbook of Antenna Engineering" (edited by IEICE (The Institute of Electronics, Information and Communication Engineers), published by Ohmsha, Oct. 30, 1980, pp. 301) describes a radome conventionally produced by sandwiching and binding a core portion having a low relative dielectric constant between skin portions having a high relative dielectric constant in order to reduce the loss.

By the way, it is required of the radome aboard an aircraft that its dielectric characteristics and mechanical strength for withstanding aerodynamic force be mutually compatible. From this viewpoint, U.S. Pat. No. 5,936,025, for instance, discloses a technology that uses a composite material consisting of a ceramic powder and a resin, limited by a mixture of $TiO_2$ and a cyanate resin in order to adjust the dielectric characteristics of the radome.

A radome having an aerodynamic shape has the property that, when the scanning angle of the antenna changes, the angle of incidence of the electromagnetic wave on the wall of the radome changes far more than the change of the scanning angle. Therefore, in the radome having an aerodynamic shape, constructed according to a conventional technology, there is the problem that the transmission loss extremely increases when the antenna operates at a certain scanning angle, thereby reducing the performance of the antenna.

Moreover, in the radome having an aerodynamic shape, fabricated by a conventional technology, since the transmission loss changes as the angle of incidence changes, the axial ratio of the antenna is disadvantageously deviated. These problems have caused a large increase of cost in antenna designs, and they have simultaneously reduced the performance of an antenna.

SUMMARY OF THE INVENTION

The present invention has been accomplished to solve the above-mentioned problems. An object of the present invention is to provide a radome in which the loss of an electromagnetic wave can be suppressed small even if the angle of incidence of the electromagnetic wave on the radome is large, and the dependence of the loss on the angle of incidence thereof is extremely small.

The radome according to the present invention includes: a first skin portion; a first core portion formed over one side surface of the first skin portion; a high relative-dielectric-constant layer formed over the side surface of the first core portion which is opposite the first skin portion; a second core portion formed over the side surface of the high relative-dielectric-constant layer which is opposite the first core portion; and a second skin portion formed over the side surface of the second core portion which is opposite the high relative-dielectric-constant layer, wherein the high relative-dielectric-constant layer has a relative dielectric constant that is more than the relative dielectric constants of the skin part consisting of the first skin portion and the second skin portion and of the core part consisting of the first core portion and the second core portion.

As mentioned above, according to the present invention, it is arranged that the wall of a radome have a structure in which a skin portion, a core portion, a high relative-dielectric-constant layer, another core portion, and another skin portion are laminated in this order. Consequently, the loss of the electromagnetic wave can be lowered over a wide range of the angle of incidence of this wave, and the distribution of the loss to the angle of incidence may be kept small.

DETAILED DESCRIPTION OF THE PREFERRED EMBODIMENTS

An embodiment of the present invention will be described below.

EMBODIMENT 1

Figure 1:
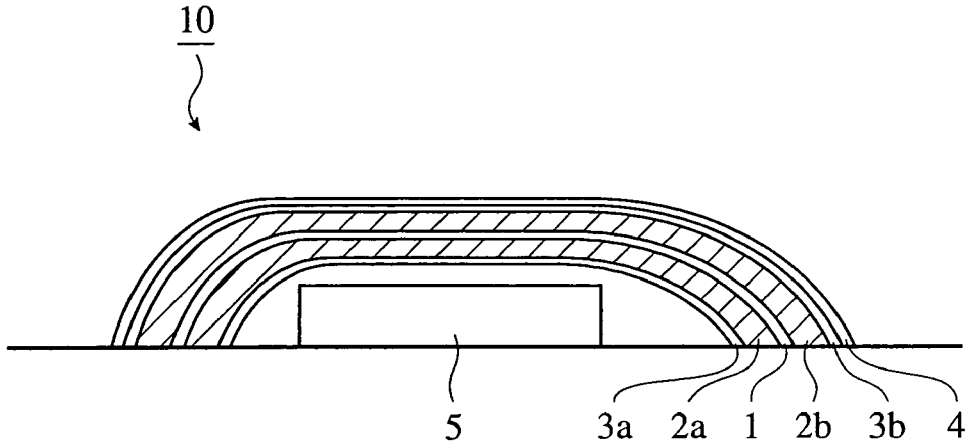
FIG. 1 is a view for explaining a radome according to a first embodiment of the present invention.
Figure 2:
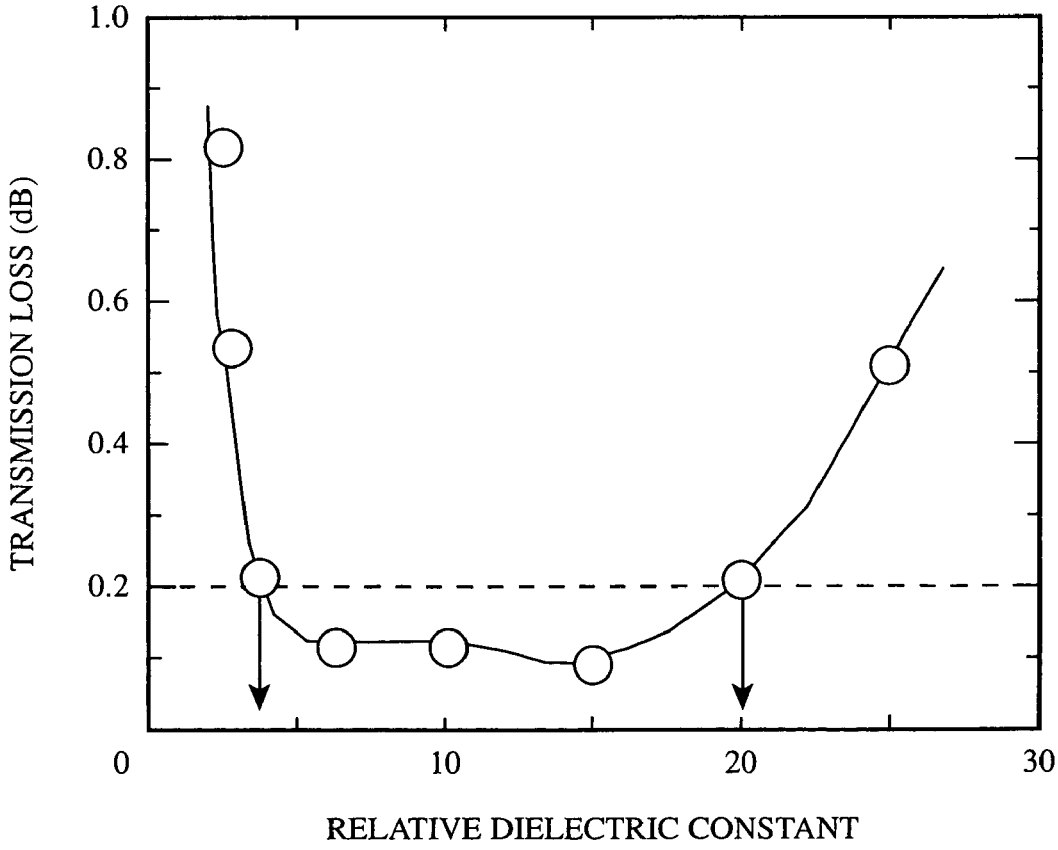
FIG. 2 is a diagram for explaining the dependence of the transmission loss against the relative dielectric constant of a high relative-dielectric-constant layer over a range of the angle of incidence of 0°–70° in the first embodiment.

A radome 10 according to a first embodiment of the present invention will be described by referring to FIG. 1 and FIG. 2. FIG. 1 is a view for explaining the radome 10 according to the first embodiment of the present invention. FIG. 2 is a diagram for explaining the dependence of the transmission loss to the relative dielectric constant of a high relative-dielectric-constant layer over a range of the angle of incidence of 0°–70° in the first embodiment.

As shown in FIG. 1, the radome 10 according to the first embodiment has a structure in which core portions (core material) 2*a*, 2*b* are laminated to the one side surface and the other side surface of a high relative-dielectric-constant layer 1, respectively, and skin portions (skin portion) 3*a*, 3*b* are additionally laminated to the one side surface and the other side surface of the obtained laminated material, respectively. Moreover, the skin portion 3*b* laminated to the outside surface of the obtained laminated material is coated with a coating material 4. The radome 10 accommodates an antenna 5.

In order to produce the radome 10 having the laminated structure shown in FIG. 1, the following process, for instance, can be used. Prepared is a prepreg that is a mixture consisting of reinforcing fiber such as quartz fiber, for instance, and resin, and that is to be transformed into the skin portions 3*a*, 3*b* after thermosetting. Meanwhile, a base material that is to be transformed into the core portions 2*a*, 2*b* after thermosetting is prepared by adding a ceramic powder that is a relative-dielectric-constant adjusting material to the main material of the core portions, then dispersing the powder in the main material of the core portions, and subsequently forming the obtained mixture into two sheets.

Furthermore, another base material that is transformed into the high relative-dielectric-constant layer 1 after thermosetting is prepared by adding a ceramic powder that is a relative-dielectric-constant adjusting material to a resin material in a predetermined amount, then dispersing the powder in the resin material, and subsequently forming the obtained material into a sheet. One half of the prepreg to be transformed into the skin portion 3*a* after thermosetting, the base material (the one sheet) to be transformed into the core portion 2*a* after thermosetting, the another base material (the other sheet) to be transformed into the high relative-dielectric-constant layer 1 after thermosetting, the base material (the second sheet) to be transformed into the core portion 2*b* after thermosetting, and the other half of the prepreg to be transformed into the skin portion 3*b* after thermosetting are stacked in this order over a molding die, and then these materials are subjected to thermosetting (laminated to each other). After that, the surface of the skin portion 3*b* of the obtained laminated product is coated with the coating material, thereby producing the radome 10.

The present inventors have studied thoroughly, and found that the transmission loss can be uniformly reduced in a sandwich panel that is produced by dividing one core portion in a direction of thickness and then placing a high relative-dielectric-constant layer having a relative dielectric constant that is more than the one of the skin portion and is also more than the one of the core portion, between the two-divided core portions. In addition, the present inventors have also found that the range of the relative dielectric constant of the high relative-dielectric-constant layer which is desired when the difference in relative dielectric constant between the skin portion and the core portion is 1.5 or less, is different from the range of the relative dielectric constant thereof which is desired when the difference thereof between the skin portion and the core portion is more than 1.5. In the latter case, the relative dielectric constant of either of the skin portion and the core portion may be made larger.

In the first embodiment, the optimum value of the relative dielectric constant of the high relative-dielectric-constant layer was determined when the difference in relative dielectric constant between the skin portion and the core portion was 1.5 or less.

In order to obtain the gain of the antenna, the transmission loss must be 0.5 dB or less, and in order to obtain the axial ratio of the antenna, the fluctuation of the transmission loss must be within 0.2 dB over a range of the angle of incidence of 0°–70°. In sandwich panels each having a high relative-dielectric-constant layer that has a relative dielectric constant differing from each other, the transmission losses were measured over a range of the angle of incidence of from 0°–70°, thereby investigating how the transmission loss in each of the panels varies. As is apparent from the results shown in FIG. 2, when the relative dielectric constant of the high relative-dielectric-constant layer is 4–20, the above-stated conditions are satisfied, thereby producing an excellent radome in which the transmission loss is small.

When the relative dielectric constant of the high relative-dielectric-constant layer is less than 4 and more than 20, the transmission loss becomes 0.5 dB or more, or the transmission loss has a fluctuation of 0.2 dB or more, thereby reducing the gain of the antenna.

In order to adjust the difference of the relative dielectric constant between the skin portion and the core portion to 1.5 or less, a ceramic powder the principal ingredient of which is $BaTiO_3$, for instance, whose relative dielectric constant is 3,500 can be added to the core portion (material) in a predetermined amount.

Furthermore, in order to adjust the relative dielectric constant of the high relative-dielectric-constant layer to 4–20, the ceramic powder the principal ingredient of which is $BaTiO_3$, for instance, whose relative dielectric constant is 3,500 can be added to the resin in a predetermined amount.

In the first embodiment, because the difference in relative dielectric constant between the core portion and the skin portion was adjusted to 1.5 or less, the adjustment of the relative dielectric constant of the high relative-dielectric-constant layer to 4–20 makes it possible to suppress the transmission loss to 0.3 dB or less over a wide range of the angle of incidence of 0°–70°.

In the first embodiment, a quartz fiber, for instance, is used as the reinforcing fiber used for the skin portion, but a similar effect can be also obtained when other reinforcing fibers are used.

In addition, in order to adjust the relative dielectric constant, the ceramic powder the principal ingredient of which is $BaTiO_3$ is added to the main material of the core portion. However, when any one at least selected from the group consisting of $BaTiO_3$, $CaTiO_3$, $MgTiO_3$, $SrTiO_3$, (Zr, Sn) $TiO_4$, $BaTi_4O_9$, $Ba_2Ti_9O_{20}$, (Mg, Ca)$TiO_3$, Ba(Zr, Ti)$O_3$, Ba(Mg, Ta)$O_3$, Ba(Zn, Ta)$O_3$, $BaTiO_4$, $WO_3$, $TiO_2$, $Bi_4Ti_3O_{12}$, $BaZrO_3$, $CaSnO_3$, alumina, and silicon is added thereto, a similar effect can be also obtained.

Moreover, in one preferred embodiment of the present invention, in order to adjust the relative dielectric constant of the core portion, $TiO_2$ that is one type of ceramic powder is added to the core portion (material). In this case, epoxy resin or the like is used as a resin material.

EMBODIMENT 2

Figure 3:
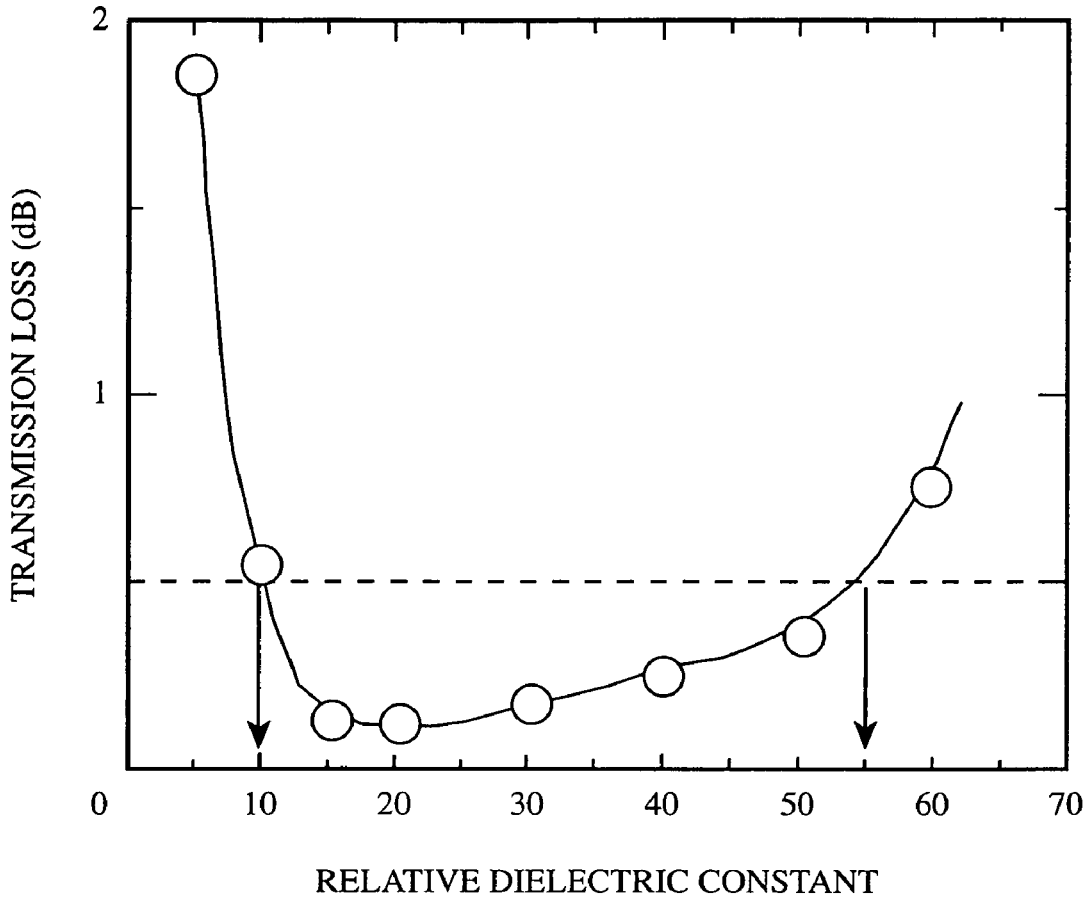
FIG. 3 is a diagram for explaining the dependence of the transmission loss to the relative dielectric constant of a high relative-dielectric-constant layer over a range of the angle of incidence of 0°–70° in a second embodiment.

A radome according to a second embodiment of the present invention will be described by referring to FIG. 3. In the second embodiment, the optimum value of the relative dielectric constant of the high relative-dielectric-constant layer was determined when the difference in relative dielectric constant between the skin portion and the core portion was more than 1.5 (although, in the first embodiment, the optimum value of the relative dielectric constant thereof was determined when the difference was 1.5 or less). FIG. 3 is a diagram for explaining the dependence of the transmission loss to the relative dielectric constant of a high relative-dielectric-constant layer over a range of the angle of incidence of 0°–70° in the second embodiment. Since the configuration and the manufacturing process of the radome according to the second embodiment are similar to the configuration and the process, respectively, described by referring to FIG. 1 in the first embodiment, the explanation is omitted.

As mentioned above, in the second embodiment, the optimum value of the relative dielectric constant of the high relative-dielectric-constant layer was determined when the difference in relative dielectric constant between the skin portion and the core portion was more than 1.5. First of all, in the sandwich panels each having a high relative-dielectric-constant layer that has a relative dielectric constant differing from each other, the transmission losses were measured over a range of the angle of incidence of 0°–70°, thereby investigating how the transmission loss varies. As is apparent from the results shown in FIG. 3, when the relative dielectric constant of the layer is 10–55, an excellent radome in which the transmission loss is small is obtained.

When the relative dielectric constant of the high relative-dielectric-constant layer is less than 10 and more than 55, the transmission loss becomes 0.5 dB or more, or the transmission loss has a fluctuation of 0.2 dB or more, thereby reducing the gain of the antenna.

In order to adjust the relative dielectric constant of the high relative-dielectric-constant layer to 10–55, a ceramic powder the principal ingredient of which is $BaTiO_3$, for instance, whose relative dielectric constant is 3,500 can be added to the resin in a predetermined amount.

In the second embodiment, since a dielectric-constant-adjusting material is not added to the core portion (material), the difference of the relative dielectric constant between the skin portion and the core portion is more than 1.5. In this case, the adjustment of the relative dielectric constant of the high relative-dielectric-constant layer to 10–55 makes it possible to suppress the transmission loss to 0.5 dB or less over a wide range of the angle of incidence of 0°–70°. This transmission loss is larger than the one obtained in the first embodiment (0.3 dB or less). However, there is practically no problem with this transmission loss.

In the second embodiment, a quartz fiber, for instance, is used as the reinforcing fiber used for the skin portions, but a similar effect can be also obtained when other reinforcing fibers are used. In addition, in order to adjust the relative dielectric constant of the high relative-dielectric-constant layer, the ceramic powder the principal ingredient of which is $BaTiO_3$ is added to the material of the layer. However, when any one at least selected from the group consisting of $BaTiO_3$, $CaTiO_3$, $MgTiO_3$, $SrTiO_3$, (Zr, Sn) $TiO_4$, $BaTi_4O_9$, $Ba_2Ti_9O_{20}$, (Mg, Ca)$TiO_3$, Ba(Zr, Ti)$O_3$, Ba(Mg, Ta)$O_3$, Ba(Zn, Ta)$O_3$, $BaTiO_4$, $WO_3$, $TiO_2$, $Bi_4Ti_3O_{12}$, $BaZrO_3$, $CaSnO_3$, alumina, and silicon is added thereto, a similar effect can be also obtained.

Moreover, in one preferred embodiment of the present invention, in order to adjust the relative dielectric constant of the material, $TiO_2$ that is one type of ceramic powder is added to the core portion (material). In this case, epoxy resin or the like is used as a resin material.

What is claimed is:

1. A radome comprising:

a first skin portion having opposed first and second surfaces;

a first core portion on the first surface of the first skin portion, the first core portion having opposed first and second surfaces, the first surface of the first core portion facing the first skin portion;

a high relative-dielectric-constant layer on the second surface of the first core portion, the high relative-dielectric-constant material layer having opposite first and second surfaces, the first surface of the high dielectric-constant-layer facing the first core portion;

a second core portion on the second surface of the high relative-dielectric-constant layer, the second core portion having opposed first and second surfaces, the first surface facing the high relative-dielectric-constant layer; and a second skin portion on the second surface of the second core portion, wherein the high relative-dielectric-constant layer has a relative dielectric constant that is larger than the relative dielectric constants of the first and second skin portions and the first and second core portions.

2. The radome according to claim 1, wherein the difference in relative dielectric constants between a skin part consisting of the first skin portion and the second skin portion and a core part consisting of the first core portion and the second core portion is no more than 1.5, and the relative dielectric constant of the high relative-dielectric-constant layer is in a range from 4 to 20.

3. The radome according to claim 1, wherein the difference in relative dielectric constants between a skin part consisting of the first skin portion and the second skin portion and a core part consisting of the first core portion and the second core portion is more than 1.5, and the relative dielectric constant of the high relative-dielectric constant layer is in a range from 10 to 55.

4. The radome according to claim 1, wherein at least one of the first and second skin portions, the first and second core portions, and the high relative-dielectric-constant layer includes at least one material selected from the group consisting of $BaTiO_3$, $CaTiO_3$, $MgTiO_3$, $SrTiO_3$, (Zr, Sn)$TiO_4$, $BaTi_4O_9$, $Ba_2Ti_9O_{20}$, (Mg, Ca)$TiO_3$, Ba(Zr, Ti)$O_3$, Ba(Mg, Ta)$O_3$, Ba(Zn, Ta)$O_3$, $BaTiO_4$, $WO_3$, $TiO_2$, $Bi_4Ti_3O_{12}$, $BaZrO_3$, $CaSnO_3$, alumina, and silicon.

* * * * *